US006081070A

United States Patent [19]

Popov et al.

[11] Patent Number: 6,081,070

[45] Date of Patent: Jun. 27, 2000

[54] HIGH-FREQUENCY ELECTRODELESS FLUORESCENT LAMP

[75] Inventors: Oleg A. Popov, Needham; Pradeep K. Nandam, Chelmsford; Edward K. Shapiro, Lexington; Jakob Maya, Brookline, all of Mass.

[73] Assignee: Matsushita Electric Works R & D Laboratories Inc., Woburn, Mass.

[21] Appl. No.: 09/083,820

[22] Filed: May 22, 1998

[51] Int. Cl.[7] ..... H01J 1/62

[52] U.S. Cl. ..... 313/490; 313/46

[58] Field of Search ..... 313/46, 43, 490, 313/493, 161

[56] References Cited

U.S. PATENT DOCUMENTS

| | | | |
|---|---|---|---|
| 4,727,295 | 2/1988 | Postma et al. | 315/248 |
| 5,355,054 | 10/1994 | Van Lierop et al. | 315/112 |
| 5,461,284 | 10/1995 | Roberts et al. | 315/57 |
| 5,572,083 | 11/1996 | Antonis et al. | 313/46 |
| 5,621,266 | 4/1997 | Popov et al. | 313/46 |
| 5,723,947 | 3/1998 | Popov et al. | 313/634 |
| 5,726,523 | 3/1998 | Popov et al. | 313/161 |

*Primary Examiner*—Vip Patel

[57] ABSTRACT

An electrodeless fluorescent lamp and fixture which operates at the frequency range of 50–1000 KHz and power from 20 to 200 W is disclosed. The lamp includes a bulbous envelope (1) filled with rare gas and metal vapor and a reentrant cavity (5). The inner walls of the envelope are coated with phosphor (2) and a protective coating (3). An induction coil (9), made from multiple strands of wire having very low resistance at frequencies below 1000 KHz, together with a ferrite core (10), having high permeability and low power losses, generates an inductively-coupled plasma in the envelope volume. The plasma generates visible and UV radiation that is converted into visible light by the phosphor coated on the envelope walls. A metallic cylinder (13), placed inside the ferrite core (10), removes the heat generated by the plasma from the coil and ferrite core and redirects the heat to the lamp base and thence to the lamp fixture. The power efficiency of the lamp operated at frequencies 200–300 KHz and its efficacy are the same as those in electrodeless RF lamps operated at frequencies of 2.65 MHz and at 13.56 MHz.

16 Claims, 4 Drawing Sheets

HIGH-FREQUENCY ELECTRODELESS FLUORESCENT LAMP

BACKGROUND OF INVENTION

This invention relates to electrodeless fluorescent lamps, and particularly to improvements in the efficiency of such lamps.

DESCRIPTION OF THE PRIOR ART

During the last several years inductively-coupled electrodeless fluorescent lamps have been introduced for indoor and outdoor illumination. These lamps employ an inductively-coupled plasma for efficient generation of visible and UV light, and have lifetimes much longer than conventional fluorescent lamps that employ hot cathodes.

In an electrodeless inductively-coupled lamp described in the prior art, U.S. Pat. No. 5,621,266 to Popov et al., the plasma was excited in an envelope filled with the mixture of rare gas (Kr, Ar, Xe) and metal vapor (mercury, sodium, and/or cadmium). The RF plasma was maintained by the azimuthal RF electric field, $E_{ind}$, induced in the envelope volume by the magnetic field, B. This magnetic field is generated by the RF current in the induction coil that is inserted in the reentrant cavity along the cavity axis.

When operating at a frequency of 13.56 MHz and employing a coil with an inductance of 2 $\mu$H, the coil current needed to maintain the RF discharge at an RF power of 60 W is relatively low, $I_{rms}\approx 1.8$A. With a resistance of the induction coil, $R_{coil}\approx 0.7$ Ohm, the coil losses, $P_{coil}\approx 2.3$ W, constitute about 5% of the total power of 60 W consumed by the RF lamp. With RF power losses in a matching network, $P_{mnw}\approx 0.5$ W, the total RF power losses in an RF lamp operated at 13.56 MHz is about 2.8 W. Thus, the efficiency of the RF lamp operated at 13.56 MHz at the RF power of 60 W is about 95%. However, the operation at 13.56 MHz has some disadvantages. The actual efficiency of the whole system., that includes a lamp, a matching network, and an RF power driver, is limited by the efficiency of an RF power driver that is relatively low at a frequency of 13.56 MHz and hardly exceeds 83%.

To increase the RF lamp system efficiency one has to reduce losses in the coil (coil wire) or improve the efficiency of the driver. It is known that the efficiency of a driver grows as frequency decreases. For instance, the efficiency of the driver of a high-frequency (HF) electrodeless lamp operated at a frequency as low as 100–200 KHz (that is, 67–135 times lower than 13.56 MHz) is expected to be as high as 90%. However, the substantial reduction of the frequency requires the proportional increase of the magnetic field generated by the induction coil. Indeed, the high-frequency circumferential voltage generated by the induction coil in the plasma, $V_{pl}$, is proportional to the product of magnetic field, $B_{pl}$, driving frequency, f, and the plasma cross section, $\pi D^2 pl/4$:

$$V_{pl}=(\pi D^2_{pl}\omega B_{pl})/4$$

Here, $\omega=2\pi f$ and is the driving angular frequency. $D_{pl}$ is the plasma diameter that is determined by the location of the plasma current maximum and is slightly larger than the diameter of the cavity, $D_{cav}$, and the coil diameter, $D_{coil}$. Typically, in the inductive discharge at pressures of 0.01–1 Torr, the plasma diameter is $D_{pl}\approx D_{cav}+10$ mm$\approx D_{coil}+10$ mm.

Since there is not much room to vary the coil diameter, the substantial (about 100 times) decrease of the driving frequency could be achieved by a proportional increase of the magnetic field in the plasma, $B_{pl}$:

$$B_{pl}=\mu_o\,\mu_{eff}\,I_{coil}\,(N_{coil}/H_{coil})$$

Here, $I_{coil}$ is the induction coil current. $N_{coil}$ and $H_{coil}$ are number of turns and coil height, respectively, $\mu_{eff}$ is the effective medium permeability.

$B_{pl}$ can be increased by the increase of the number of turns, by the coil current increase, and by the increase of the permeability of the medium, e.g., by the introduction of the ferrite material in the cavity. The substantial increase of the number of turns and the coil current results in the proportional increase of the magnetic field to the level that allows operation at frequencies down to 600–700 KHz. However, the increase of the number of turns and the coil current leads also to the substantial increase of power losses in coil wire, $P_{coil}=I_{coil}^2\,R_{coil}$. Therefore, the practical way to operate at low frequencies below 500 KHz is to use a ferrite core with high permeability and low power losses.

In the prior art, where the operation of electrodeless RF lamps was at a "modest" frequency of 2.65 MHz, that is, about 5 times lower than 13.56 MHz, a ferrite core with a permeability of about 2000 was employed (U.S. Pat. No. 4,727,295 to Postma et al. and U.S. Pat. No. 5,461,284 to Roberts et al.). It is known that the power losses in ferrites increase with magnetic field faster than $B^2$ while they increase with frequency almost linearly (at a fixed magnetic field). It is seen from the above ($V_{pl}=(\pi D^2_{pl}\,\omega B_{pl})/4$) that at fixed $V_{pl}$ (that is determined by gas pressure and lamp geometry), $B_{pl}$ $f^{-1}$. Therefore, power losses in the ferrite core, $P_{ferr}$ $f^{-1}$. These losses could be substantial in lamps where high voltage and, hence, high coil current and high magnetic field are needed for lamp starting.

The power losses in the coil wire are also expected to be higher at lower frequencies because the coil current is inversely proportional to the driving frequency. High power losses-substantially reduce the lamp efficiency. Therefore, it is desirable to operate a lamp at low coil current and to construct the induction coil from wire having very low resistance at low frequencies.

The operation at a low frequency also allows the location of a matching network/ballast at a much greater distance from the lamp, provided the wire between the coil and the matching network is not lossy. This arrangement could give more flexibility to the luminair designer allowing the separation of the lamp and fixture from the matching network and from the driver. In an RF lamp operated at a frequency of 13.56 MHz, a matching network has to be located as close as possible to the induction coil, e.g., in the lamp base. However, the placement of the matching network components in the base, in the proximity of the plasma, exposes those components to the extensive heat and, hence, requires an efficient means for cooling of all components so their temperature does not exceed maximum admissible temperature. Typically this temperature is around 90° C.

In U.S. Pat. No. 5,621,266 to Popov et al., the matching network of a lamp operating at a frequency of 13.56 MHz and at RF power of 60 W, was located inside the lamp base. Plasma-generated heat was removed from the inner cavity and from the induction coil by a slotted aluminum cylinder welded to the lamp base. The heat was redirected from the cylinder to the base and then was transferred to a lamp fixture. Such an arrangement was sufficient to maintain the temperature of the components of the matching network below 90° C.

The aluminum cylinder inserted between the induction coil and the cavity walls worked also as a Faraday shield that reduced capacitive coupling between the coil and the plasma and, hence, reduced RF capacitive voltage across the sheath between the cavity walls and the plasma. Therefore, the plasma ions traveling across the sheath from the plasma to the negatively self-biased cavity walls acquire less energy, thereby reducing the damage they cause to the cavity walls' phosphor coating and, hence, improve lamp maintenance. However, the introduction of the aluminum cylinder, in a manner described in the U.S. Pat. No. 5,621,266, caused an increase of the lamp starting voltage due to the reduction of capacitive coupling between the coil and the plasma.

To reduce the capacitive discharge voltage, U.S. Pat. No. 5,723,947 to Popov et al. discloses widening the top portion of the inner cavity tubulation that was not shielded from the induction coil with a Faraday shield. This allows ignition of the capacitive discharge inside the top portion of the tubulation at low RF voltage. The plasma of this discharge diffuses outside of the tubulation to the area of the main discharge, thereby lowering the ignition voltage in this area to the value equal (or very close) to that without the aluminum cylinder.

It is important to note that the introduction of the 1 mm thick aluminum cylinder between the coil and the cavity walls requires the reduction of the coil diameter and, hence, a lowering of the inductive coupling between the coil (primary) and the plasma (secondary). Indeed, the coil-plasma coupling coefficient, k, is determined as:

$$k=D^2_{coil}/D^2_{pl}$$

The reduction of k causes the increase of the coil current, $I_{coil}$, and, hence, coil voltage, $V_{coil}$. As a result, the coil consumes more RF power, $P_{coil}=I^2_{coil}R_{coil}$, so the lamp power efficiency gets lower. The increase of the coil voltage is also not desirable because it leads to the increase of the RF voltage in the plasma-wall sheath that in turn causes the growth of energy of ions bombarding the phosphor coated walls.

Axial cuts in the cylinder walls reduce the azimuthal current induced in the cylinder walls by the magnetic field. However, this current generates its own magnetic field of the opposite direction that results in the lower coil inductance. The lower coil inductance leads to the smaller coil Q factor ($Q=\omega L_{coil}/R_{coil}$) wherein $L_{coil}$ is coil inductance and $R_{coil}$ is coil resistance. A smaller Q factor thereby increases the coil current, $I_{coil}$, and, hence, increases the power losses in the coil wire.

In order to provide sufficient cooling of the coil and ferrite, the prior art (U.S. Pat. No. 5,355,054 to Van Lierop et al.) employed a heat pipe with cooling liquid. This approach works well at RF-powers up to 80 W, however, the lamp construction becomes complicated and more expensive. In U.S. Pat. No. 5,572,083 to Antonis et al., patentees used a solid rod inserted in a tube-shaped ferrite to remove the plasma-generated heat, and redirected the heat to the lamp base and then to the lamp fixture. However, this approach is not applicable for a lamp having a central tubulation.

Moreover, the introduction of the solid metal rod inside of the coil/ferrite assembly causes, inevitably, power losses associated with eddy current induced in the solid rod by the time-variable and radially nonuniform magnetic field generated by the coil/ferrite assembly.

The use of the solid rod along the cavity axis has several disadvantages. First, it does not have axial cuts which reduce eddy currents induced in the solid rod metal (even made from Al and Cu) by the radial nonuniform magnetic field. To reduce eddy currents, a rod must be located in the area where dBz/dr=O, that is, the ferrite axis. But in this case, the cross section of the rod should be extremely small, approaching zero. With such a small cross section, it is impossible to remove a substantial amount of heat generated by 40–60 W plasma. Second, it is impossible to place a solid rod at the cavity axis in the presence of the central tubulation and, therefore, the Antonis et al. patent is not applicable to electrodeless lamps having the tubulation located on the axis of the cavity but on the side of the cavity or on the top of the envelope. Our invention can utilize both central and side tubulation.

We also found that eddy currents in a metal slotted cylinder inserted between the coil and the cavity walls (Faraday shield/heat removal in our U.S. Pat. No. 5,621,266) are higher at low frequencies of 50–300 KHz than those at a frequency of 13.56 MHz. This results in higher power loss and a substantial reduction of the combined coil/ferrite/shield inductance. All these factors make it impractical to use a slotted metal cylinder/Faraday shield between the coil and the cavity walls at low frequencies of 50–300 KHz.

Many features of the electrodeless lamps described in the prior art are suitable for lamps operated at frequencies of 2.65–13.56 MHz, but are not suitable for lamps operated at low frequencies of 50–1000 KHz.

SUMMARY OF THE INVENTION

An object of the present invention is to design a light source operating at a frequency that is substantially lower than 13.56 MHz, preferably 50–1000 KHz, and that has a lamp power efficiency higher than (or equal to) that operated at a frequency of 13.56 MHz.

Another object of the present invention is to provide means (coil, ferrite) to generate high magnetic field in the plasma area at frequencies of 50–1000 KHz, without substantial increase of the coil current and without reducing the lamp power efficiency.

Another objective of the present invention is to provide the means to remove the heat from the cavity of the lamp operating at a low frequency of 50–1000 KHz to make the coil and ferrite to be operable at ambient temperatures up to 50° C.

A further object of the present invention is to provide a low starting voltage in a lamp operating at a frequency of 50–1000 KHz.

Yet another object of the present invention is to maintain the lamp coil voltage during operation at a low value of about 200 V or lower so as to reduce energy of ions bombarding the cavity walls, thereby to improve the lamp maintenance.

Another object is to provide a long-life electrodeless lamp system that is manufacturable and has low cost.

According to our invention, we provide an induction coil made from Litz wire and a hollow slotted cylinder located on the cavity axis for operation at a low frequency, between 50 and 1000 KHz.

SPECIFIC EMBODIMENTS OF THE INVENTION

Figure 1A:
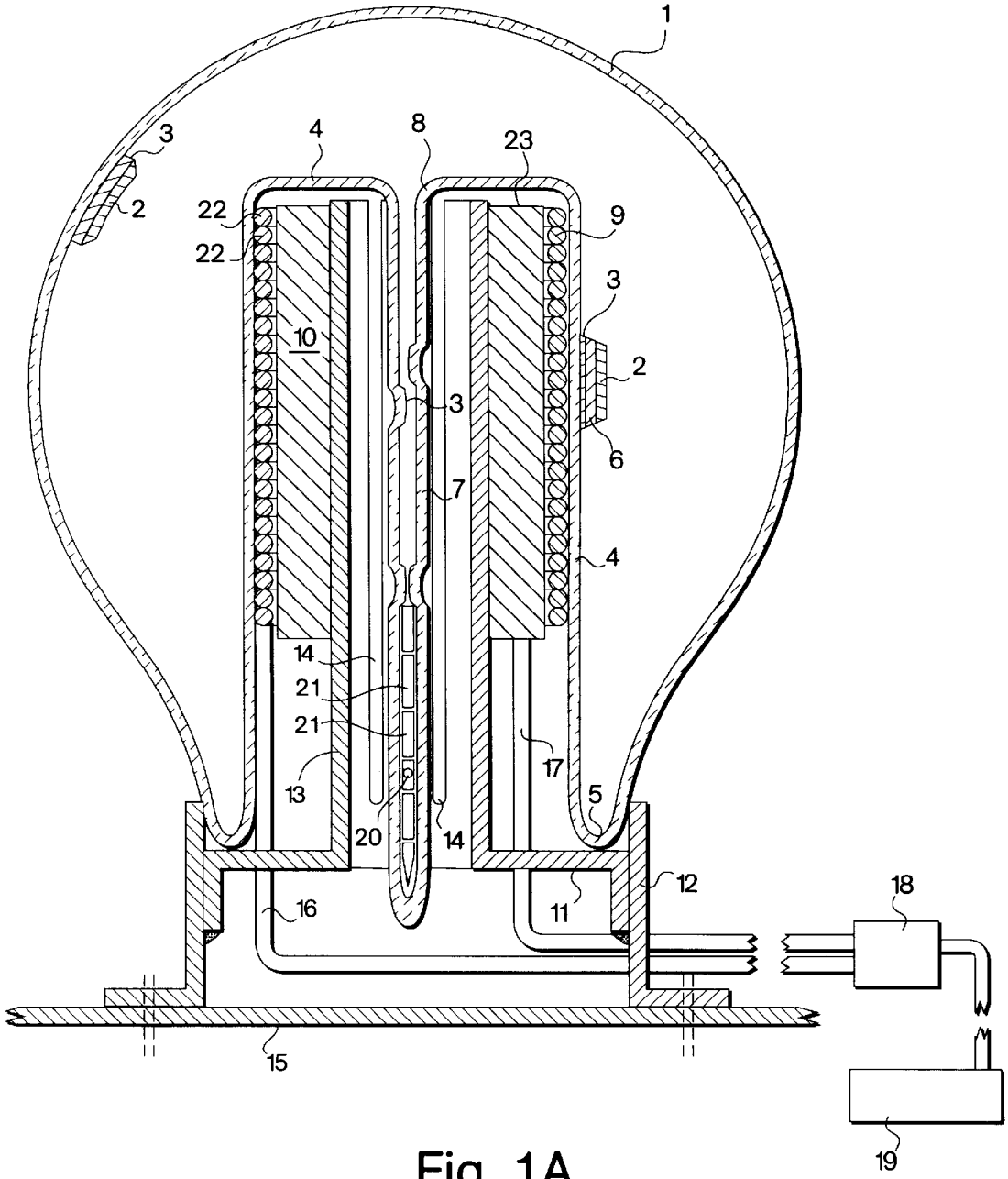
FIG. 1*a* is a cross section of a low-frequency electrodeless lamp with a coil made from multiple-strand Litz wire and with a slotted inner metal cylinder.
Figure 1B:
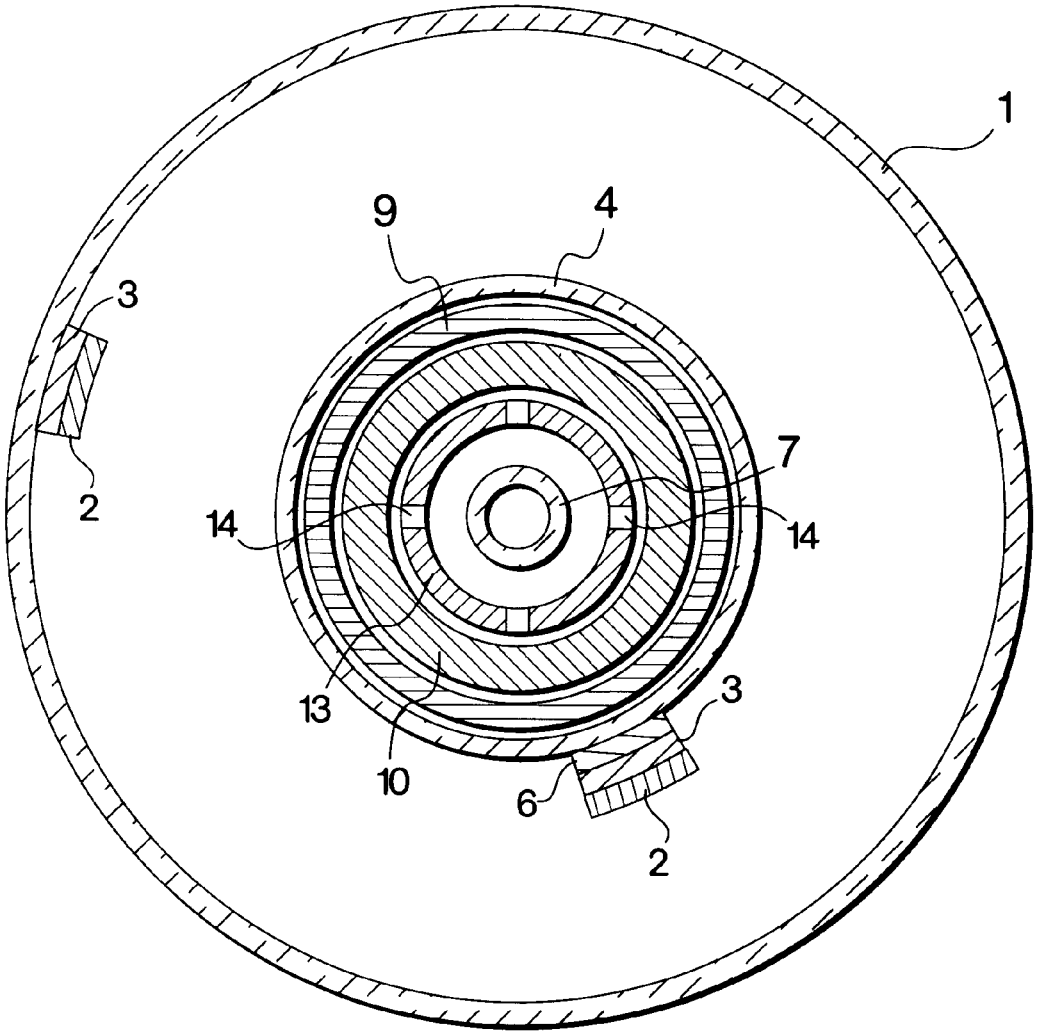
FIG. 1*b* is a top view of the lamp shown in FIG. 1.

Referring to FIGS. 1*a* and 1*b*, a bulbous envelope 1 is shown with a coating 2 of a conventional phosphor. A protective coating 3 formed of silica or alumina, or the like, is disposed between the envelope 1 and the phosphor coating 2. The envelope 1 has a reentrant cavity 4 disposed in the bottom 5. The inner walls of the reentrant cavity 4 also have the phosphor coating 2 and the protective coating 3. A reflective coating 6 is disposed between the phosphor coating 2 and the protective coating 3. The protective coating 2 is also disposed on the inner walls of an exhaust tubulation 7. The tubulation 7 can be disposed on the envelope axis or off the envelope axis. In the preferred embodiment, the tubulation 7 is disposed on the envelope axis and connected to the envelope at the upper part 8 of the inner cavity 4. The envelope 1 contains a mixture of inert gas such as argon or krypton, or the like, and a vaporizable metal, such as mercury, sodium and/or cadmium.

An induction coil 9 is formed of multiple strands (50–600 strands) of wire, often called Litz wire, made from metal having high electrical and thermal conductivity, such as copper or silver. Each strand of the wire is electrically isolated and the wire cross section can be from 0.002 $cm^2$ up to 0.3 $cm^2$. Such wire has a very low resistance per length unit due to the substantial reduction of the skin-effect. The wire has an electrical and thermal isolation that makes the coil 9 operable at coil temperatures up to 200° C.

The coil 9 is wound around a ferrite hollow core 10 made from material having high permeability (>2000). The ferrite core has a high Curie temperature (Tc>200° C.) and low power losses at frequencies of 50–1000 KHz. In the preferred embodiment, a ferrite core 60 mm in height and 30 mm in outer diameter and 18 mm in inner diameter was employed. At a driving frequency of 100 KHz, and with the magnetic field at the ferrite core of about 600G, the power losses are less than 100 $mW/cm^3$ at ferrite temperatures from −10° C. to +150° C.

The induction coil 9 has from 5 to 50 turns depending on the length of cavity 4. The coil has pitches between the turns, and each pitch has a height from 0.1 to 15 mm. The combined inductance of the coil/ferrite core assembly has a value from 10 to 200$\mu$H. The bottom 5 of the envelope 1 is disposed on the top surface 11 of the lamp base 12.

A cylinder 13 made from a material having high thermal conductivity, such as aluminum, copper, or the like, is inserted in the cavity between the tubulation 7 and the ferrite core 10. To reduce eddy currents, the cylinder 13 has more than one axial cut 14. Each cut has a width between 1 and 5 mm. The cylinder 13 is welded to the base top surface 11 and removes the heat generated by the plasma from the coil 9 and the ferrite core 10, and transfers it to the base 12. The base 12 is welded to the fixture 15 where the heat is eventually redirected.

Leads 16 and 17 of the coil 9 are also made from the multiple strands of wire and connect the induction coil 9 to the matching network 18, located outside of the lamp base 12. One of the leads is connected to the high HF voltage terminal of the matching network 18 and the other lead is HF grounded. The cylinder 13 is HF grounded.

The high-frequency driver 19 provides the matching network 18 with the voltage and current of the required frequency, that can be from 20 to 2000 KHz.

The amalgam 20 is located inside the tubulation 7. It provides metal vapor (mercury, sodium, cadmium, or the like) in the envelope and controls metal vapor pressure therein. A few pieces of glass rods 21 are placed in tubulation to keep the amalgam in the chosen place.

The lamp is operated as follows. The high-frequency voltage is applied via the matching network across the induction coil 9. When the electric field generated in the envelope volume adjacent the turns of the coil having high potential to ground reaches its breakdown value, $E_{cap}$, a capacitive discharge appears in this area. (If the high voltage is applied to the upper turns 22, the capacitive discharge is ignited in the volume adjacent to the coil upper turns.)

As the coil voltage and current are increased, the plasma density of the capacitive discharge also increases. The high-frequency coil current generates (induces), in the plasma, a high-frequency magnetic field, $B_{pl}$, which in turn generates, in the plasma, an azimuthal electric field, $E_{ind}$. When $E_{ind}$ reaches a value that is high enough to ignite in the plasma (a self-sustained azimuthal inductive discharge), a transition occurs from a relatively weak capacitive discharge to a very bright, predominantly inductive discharge. Both coil voltage and coil current drop significantly from their high values at the transition to much lower values that are needed to maintain an inductive discharge. The values of coil voltage and current at the transition (that is, the starting of the lamp) depend on the envelope and the cavity diameters and length, inert gas and metal vapor pressures, the driving frequency and the number of turns.

The HF power needed for the lamp starting is determined by the losses in the ferrite core and in the coil wire. Due to the low resistance of the Litz wire and low power losses in the ferrite core, the power losses at the starting (transition) are very low. For instance, for the HF electrodeless lamp shown in FIG. 1 (the coil/ferrite core assembly has the inductance of 50 $\mu$H), the starting HF power at a frequency of 100 KHz is 40 W. The increase of the frequency leads to the decrease of the starting power up to 20 W at f=200 KHz.

The low coil and ferrite core power losses result in high lamp power efficiency, $n=P_{pi}/P_{lamp}$. Here $P_{pi}$ ($P_{pi}=P_{lamp}-P_{loss}$) is the power absorbed by the lamp plasma, $P_{lamp}$ is the total HF power delivered to the lamp from the driver, $P_{loss}$ is the power losses in the coil and in the ferrite core.

Figure 2:
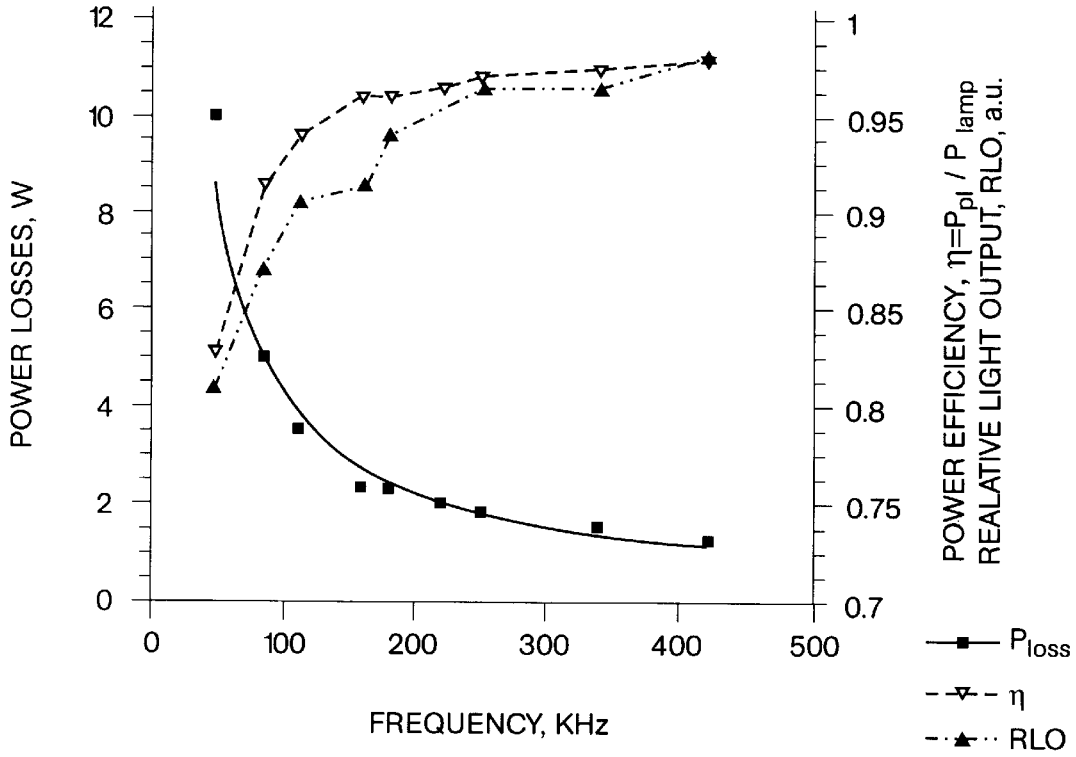
FIG. 2 is a curve showing power losses in the coil/ferrite assembly, the lamp power efficiency, and the lamp relative light output as functions of driving frequency. The lamp power is 60 W.

The high lamp power efficiency is expected to result in high lamp light output. The dependencies of $P_{loss}$, $\eta$, and the lamp relative light output (RLO) on the driving frequency are shown in FIG. 2 at the HF power of 60 W.

It is seen that $P_{loss}$ grows as the driving frequency decreases. At a low frequency of about 80 KHz the power losses do not exceed 5 W. As a result, in a lamp operated at power of 60 W and at a frequency higher than 80 KHz, the power losses in the coil and in the ferrite core do not constitute more than 10% of the total power of 60 W delivered to the lamp. As the driving frequency increases, the power losses decrease, and at the frequency of about 200 KHz the power losses are as low as about 2 W. Thus, the power efficiency of the lamp operated at a frequency of 200 KHz is essentially the same as that of the lamp operated at the frequency of 13.56 MHz.

It can also be seen that the lamp power efficiency, $\eta$, and RLO have similar frequency dependencies. Both grow with the frequency and tend to "saturate" at frequencies of 400–500 KHz, where the lamp power efficiency and RLO reach their maximum value of about 98%.

The portion of the heat generated by the plasma is transferred through the coil 9 and the ferrite core 10 to the metal slotted cylinder 13 that is welded to the base top surface 11. This heat is transferred to the base 12 and then to the fixture 15. Though the coil is exposed to the plasma radiation, the presence of the 1.5 mm thick aluminum cylinder 13 provides sufficient cooling for the coil and the ferrite core.

Figure 3:
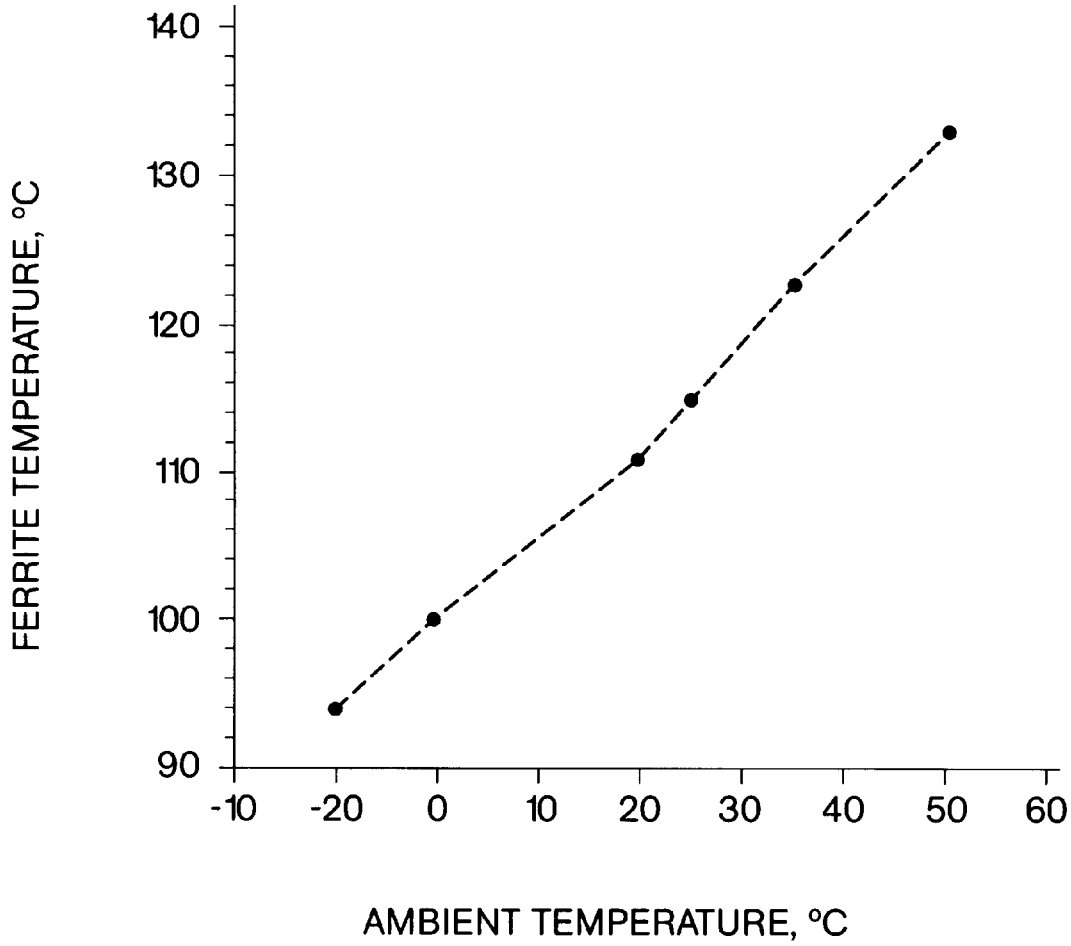
FIG. 3 is a curve showing the ferrite temperature as the function of the ambient temperature. The lamp power is 60 W. The driving frequency is 164 KHz.

We performed the experiments with the electrodeless fluorescent lamp operated at a frequency of 165 KHz at power of 60 W and at ambient temperatures ranging from −20° C. to +50° C. The lamp base was attached to the heat sink that simulated the lamp fixture and the lamp was in the base down position. The temperature of the hottest spot on the ferrite surface 23 was monitored during the lamp burning. The temperature at the spot 23 was measured after 2 hours of lamp burning at the chosen ambient temperature. The results of these measurements are shown in FIG. 3. It is seen that ferrite core temperature grows linearly with the ambient temperature, but even at $T_{amb}$=50° C. the hottest ferrite temperature was around 135° C., that is, far below ferrite Curie temperature ($T_{curie}$=220° C.). The coil's hottest spot was around 160° C., that was also below the maximum coil temperature of about 200° C.

It is apparent that modifications and improvements may be made within the spirit and scope of the present invention.

As our invention we claim:

1. An electrodeless fluorescent high-frequency lamp and fixture comprising:

a bulbous lamp envelope and a reentrant cavity disposed in said envelope, a rare gas and vaporizable metal fill in said envelope, and a phosphor coating on the interior of the envelope for the generation of visible light;

a lamp base disposed outside said envelope and said fixture, said fixture being attached to said lamp base;

an induction coil for the generation of a plasma to produce radiation to excite said phosphor coating, said coil made from multiple strands of wire, said coil situated outside said envelope and fitted within said cavity;

a ferrite core disposed inside said coil to increase the magnetic field generating in said plasma an azimuthal electric field igniting and maintaining said plasma;

means to remove heat generated by said plasma from said cavity, said means being disposed in said cavity inside said ferrite and welded to the lamp base, said ferrite core and said coil whereby to redirect said heat to said fixture;

means to suppress capacitive coupling between said coil and central tubulation to prevent the formation of a plasma inside said tubulation thereby reducing ion bombardment of the protective coating inside said tubulation thereby improving lamp maintenance; and an amalgam disposed in said tubulation to control metal vapor pressure in said envelope.

2. The lamp and fixture according to claim 1 wherein said coil wire has 30 to 800 strands in the wire.

3. The lamp and fixture according to claim 1 wherein said wire has the cross section diameter from 0.2 mm to 2.0 mm.

4. The lamp and fixture according to claim 1 wherein said wire material is copper, silver, or the like.

5. The lamp and fixture according to claim 1 wherein said wire has electrical insulation.

6. The lamp and fixture according to claim 1 wherein said coil is connected to the matching network with the leads made from said multiple strands of wire.

7. The lamp and fixture according to claim 2 wherein the AWG of each wire in the strand is from #20 to #50.

8. The lamp and fixture according to claim 1 wherein said matching network is located at the distance from the lamp ranging from 50 mm to 1000 mm.

9. An electrodeless high-frequency fluorescent lamp and fixture comprising a lamp envelope with a reentrant cavity disposed therein, rare gas and vaporizable metallic fill, a phosphor coating on the interior of said envelope to generate visible light, a lamp base disposed outside said envelope and attached to said fixture;

an induction coil made from multiple strands of wire and disposed inside said cavity for the generation of a plasma in said envelope where said plasma generates radiation to excite said phosphor to produce said visible light;

a ferrite core disposed inside the said cavity to increase a magnetic field in said envelope-generating azimuthal high-frequency electric field where said electric field ignites and maintains said plasma;

a cylinder made from metal having high thermal conductivity and low eddy current at high frequencies of 50–1000 KHz, said cylinder being disposed on the axis of said cavity between said ferrite core and the central tubulation and welded to the lamp base, said cylinder being arranged to remove plasma-generated heat from said ferrite core and said coil and redirect the heat to said base and thence to said fixture.

10. The lamp and fixture according to claim 9 wherein said cylinder has several axial slits to reduce eddy currents and to reduce effect of the azimuthal current in the cylinder, thereby diminishing effect of the magnetic field generating by said current on the inductance of said coil, the width of said slits being between 1 and 4 mm.

11. The lamp and fixture according to claim 10 wherein said cylinder has between 2 and 8 axial slits.

12. The lamp and fixture according to claim 9 wherein said cylinder has walls with a thickness between 0.3 and 3 mm.

13. The lamp and fixture according to claim 9 wherein the top edge of said cylinder sticks out from said ferrite, or flashes with the ferrite edge, or is positioned at any place inside said ferrite provided the outer walls of said cylinder have good physical and thermal contact with the inner walls of said ferrite core.

14. The lamp and fixture according to claim 9 wherein said cylinder and said ferrite core are grounded.

15. The lamp and fixture according to claim 9 wherein said coil wire has 30 to 800 strands in the wire.

16. The lamp and fixture according to claim 15 wherein the AWG of each wire in the strand is from #20 to #50.

* * * * *